US008567210B2

(12) United States Patent
Park et al.

(10) Patent No.: US 8,567,210 B2
(45) Date of Patent: Oct. 29, 2013

(54) REFRIGERATOR HAVING AN ICE MAKER WITH VERTICAL FREEZING CORES

(75) Inventors: Hong-Hee Park, Seoul (KR); Tae-Hee Lee, Seoul (KR); Joon-Hwan Oh, Seoul (KR); Young-Jin Kim, Seoul (KR); Ho-Youn Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 515 days.

(21) Appl. No.: 12/864,970

(22) PCT Filed: Oct. 1, 2008

(86) PCT No.: PCT/KR2008/005786

§ 371 (c)(1),
(2), (4) Date: Jul. 28, 2010

(87) PCT Pub. No.: WO2009/096651

PCT Pub. Date: Aug. 6, 2009

(65) Prior Publication Data

US 2010/0319387 A1 Dec. 23, 2010

(30) Foreign Application Priority Data

Jan. 31, 2008 (KR) ..... 10-2008-0009998

(51) Int. Cl.
*F25D 3/00* (2006.01)
*F25C 1/00* (2006.01)
*F25C 1/18* (2006.01)

(52) U.S. Cl.
USPC ..... 62/377; 62/420; 62/353; 62/354; 62/66; 62/71; 62/346; 62/425; 62/344; 62/515; 62/449; 62/68; 62/137; 62/138; 62/139

(58) Field of Classification Search
USPC ..... 62/377, 420, 353, 354, 425, 344, 515, 62/449, 71, 346, 66, 68, 137, 138, 139
See application file for complete search history.

(56) References Cited

U.S. PATENT DOCUMENTS

| | | | | |
|---|---|---|---|---|
| 5,187,948 | A * | 2/1993 | Frohbieter | 62/351 |
| 2005/0126201 | A1 * | 6/2005 | Navedo et al. | 62/344 |
| 2005/0252232 | A1 * | 11/2005 | Lee et al. | 62/340 |
| 2008/0264082 | A1 * | 10/2008 | Tikhonov et al. | 62/137 |

FOREIGN PATENT DOCUMENTS

| | | | |
|---|---|---|---|
| KR | 10-20050028657 | A | 3/2005 |
| KR | 10-20060110549 | A | 10/2006 |
| KR | 10-0716254 | B | 5/2007 |

OTHER PUBLICATIONS

International Search Report dated Apr. 29, 2009 for Application No. PCT/KR2008/005786, 2 pages.

* cited by examiner

*Primary Examiner* — Allen Flanigan
*Assistant Examiner* — Charissa Garcia
(74) *Attorney, Agent, or Firm* — Fish & Richardson P.C.

(57) ABSTRACT

Provided is a refrigerator configured to improve the structure of an ice-making chamber provided to a refrigerator door, thereby efficiently supplying cool air into the ice-making chamber. The refrigerator includes a main body including a storage chamber, a refrigerator door rotatably coupled to the main body, an ice-making device provided to the refrigerator door and configured to make ice, an ice-making unit provided to the ice-making device and including a cool air introduction part, a freezing core vertically arranged in the ice-making unit and cooled by cool air, and an ice tray configured to receive at least one portion of the freezing core therein, wherein the cool air introduction part is provided on an upper side of the freezing core. Cool air is efficiently introduced into the ice-making chamber, thereby increasing the amount of ice made.

14 Claims, 4 Drawing Sheets

REFRIGERATOR HAVING AN ICE MAKER WITH VERTICAL FREEZING CORES

TECHNICAL FIELD

The present disclosure relates to a refrigerator.

BACKGROUND ART

In the related art, a refrigerator includes a plurality of storage chambers for storing foods at low temperatures close to or below zero degrees Celsius. Each of the storage chambers has an open side for allowing access to the foods stored in the storage chambers.

Recently, a refrigerator having a dispenser for dispensing ice and water has been developed. A water tank for storing water that will be dispensed is connected to the dispenser.

An ice-making chamber for making ice using the water supplied is provided in the refrigerator. The ice-making chamber may be installed in a main body of the refrigerator or a door of the refrigerator.

When the ice-making chamber is provided at a chilling chamber, the ice-making chamber is formed in a thermal insulation structure to provide a low temperature environment. A passage through which cool air of a freezing chamber can be introduced and discharged is formed through side surfaces of the ice-making chamber and the refrigerator.

An ice tray may be provided in the ice-making chamber such that supplied water is converted into ice by received cool air. That is, cool air is supplied to the ice tray in which water is filled so as to make ice.

The structure of the related art ice-making chamber has a limitation that cool air supplied into the ice-making chamber is not efficiently supplied to the ice tray, and thus ice-making volume is decreased.

Also, since the supply of cool air is inefficient, it is difficult to obtain clear ices having uniform sizes.

DISCLOSURE OF INVENTION

Technical Problem

Embodiments provide a refrigerator configured to improve the structure of an ice-making chamber provided to a refrigerator door, thereby efficiently supplying cool air into the ice-making chamber.

Embodiments also provide a refrigerator is adapted such that cool air supplied into an ice-making chamber flows toward freezing cores, thereby making the temperature of the freezing cores low to increase ice-making volume.

Embodiments also provide freezing cores having uniform temperature distribution in an ice-making process by supplying cool air from the upper portion of an ice-making chamber to the lower portion of the ice-making chamber.

Technical Solution

In one embodiment, a refrigerator includes: a main body including a storage chamber; a refrigerator door rotatably coupled to the main body; an ice-making device provided to the refrigerator door and configured to make ice; an ice-making unit provided to the ice-making device and including a cool air introduction part; a freezing core vertically arranged in the ice-making unit and cooled by cool air; and an ice tray configured to receive at least one portion of the freezing core therein, wherein the cool air introduction part is provided on an upper side of the freezing core.

In another embodiment, a refrigerator includes: a main body including a storage chamber; a refrigerator door rotatably coupled to the main body; an ice-making unit provided to the refrigerator door and including a cool air introduction part configured to introduce cool air supplied from the main body; a freezing core arranged in the ice-making unit and cooled by the cool air; and an ice tray, where supplied water is converted into ice, on a lower side of the freezing core, wherein the cool air introduction part includes a first cool air introduction part provided to an upper portion of the ice-making unit.

In further another embodiment, a refrigerator includes: a main body including a storage chamber; a refrigerator door rotatably coupled to the main body; an ice-making unit provided to the refrigerator door, cool air being introduced to the ice-making unit; a water supply unit configured to supply water to the ice-making unit; an ice tray configured to convert the water supplied from the water supply unit into ice; a freezing core disposed on an upper side of the ice tray and configured to freeze the water; and a cool air passage provided to the refrigerator door and configured to introduce the cool air toward an upper side of the freezing core.

Advantageous Effects

According to the above configuration of the refrigerator, cool air is supplied from the upper side of the ice-making chamber provided to the refrigerator door, so that the cool air is directly supplied toward the freezing cores.

Accordingly, the freezing cores are maintained at a low temperature adapted for making ice, and thus ice-making volume is increased.

Also, since cool air is uniformly delivered to the freezing cores, the sizes of ices made are uniform.

Also, since the freezing cores are uniformly cooled, ice generated at the freezing cores is clear.

MODE FOR THE INVENTION

Reference will now be made in detail to the embodiments of the present disclosure, examples of which are illustrated in the accompanying drawings. The present disclosure may, however, be embodied in different forms and should not be constructed as limited to the embodiments set forth herein. Rather, these embodiments are provided so that this disclosure will be thorough and complete, and will fully convey the scope of the present disclosure to those skilled in the art.

Figure 1:
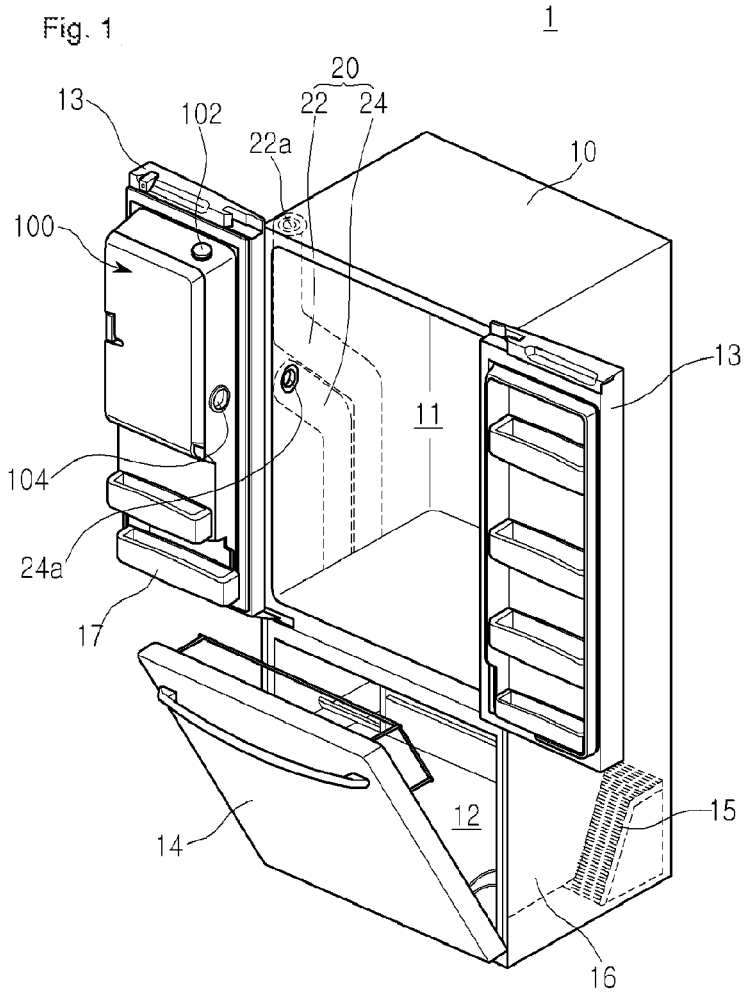
FIG. 1 is a perspective view illustrating a refrigerator according to an embodiment.

FIG. 1 is a perspective view illustrating a refrigerator 1 according to an embodiment.

Referring to FIG. 1, the refrigerator 1 includes a main body 10 having a chilling chamber 11 and a freezing chamber 12, a chilling chamber door 13 that is rotatably coupled to a front surface of the main body 10 to selectively open and close the chilling chamber 11, and a freezing chamber door 14 that is provided in a lower portion of the main body 10 to selectively open and close the freezing chamber 12. Here, the chilling chamber 11 is disposed in an upper portion of the main body 10, and the freezing chamber 12 is disposed in the lower portion of the main body 10.

In this embodiment, a description will be made on a bottom freezer type refrigerator where the freezing chamber is defined under the chilling chamber. However, the present disclosure is not limited to this embodiment. For example, the present disclosure may be applied to not only a top mount type refrigerator where the freezing chamber is defined above the chilling chamber but also a side-by-side type refrigerator where the freezing and chilling chambers are defined at right and left sides, respectively.

In more detail, the chilling chamber door 13 is divided into two sections that are respectively coupled to both sides of the main body 10 by hinges (not shown). The freezing chamber door 14 is coupled to a lower end of the main body 10 by a hinge (not shown) and is designed to be withdrawn in the form of a drawer.

A storage container 16 may be provided in the freezing chamber 12. The storage container 16 is configured to store frozen foods and be withdrawn forward according to the withdrawing of the freezing chamber door 14.

In addition, an evaporator 15 for generating cool air that will be supplied into the main body 10 is provided at a lower-rear portion of the main body 10.

An inner surface of the chilling chamber door 13 is provided with an ice-making device 100 and a plurality of baskets 17. The ice-making device 100 is configured to make ice. The baskets 17 are provided on one side of the ice-making device 100 and configured to store foods.

The ice-making device 100 includes a cool air supply part 102 and a cool air discharge part 104 on one side surface thereof. The cool air supply part 102 is configured to supply at least one portion of cool air supplied to the freezing chamber 12. The cool air discharge part 104 is configured to discharge cool air circulating in the ice-making device 100 toward the evaporator 15.

A supply duct 22 configured to supply cool air to the cool air supply part 102, and a discharge duct 24 in which cool air discharged from the cool air discharge part 104 flows, are provided at one side surface in the main body 10.

First sides of the supply duct 22 and the discharge duct 24 are connected to the freezing chamber 12. At least one portion of cool air generated by the evaporator 15 is supplied to the ice-making device 100 through the supply duct 22. The cool air circulating in the ice-making device 100 is discharged into the freezing chamber 12 through the discharge duct 24.

Duct supply and discharge holes 22*a* and 24*a* are respectively formed on second ends of the supply and discharge ducts 22 and 24. The duct supply and discharge holes 22*a* and 24*a* respectively communicate with the cool air supply and discharge parts 102 and 104.

Here, the duct supply and discharge holes 22*a* and 24*a* are exposed on an inner surface of the main body 10 to correspond to the cool air supply and discharge parts 102 and 104 such that, when the chilling chamber door 13 is closed, the duct supply and discharge holes 22*a* and 24*a* communicate with the cool air supply and discharge parts 102 and 104, respectively.

Figure 2:
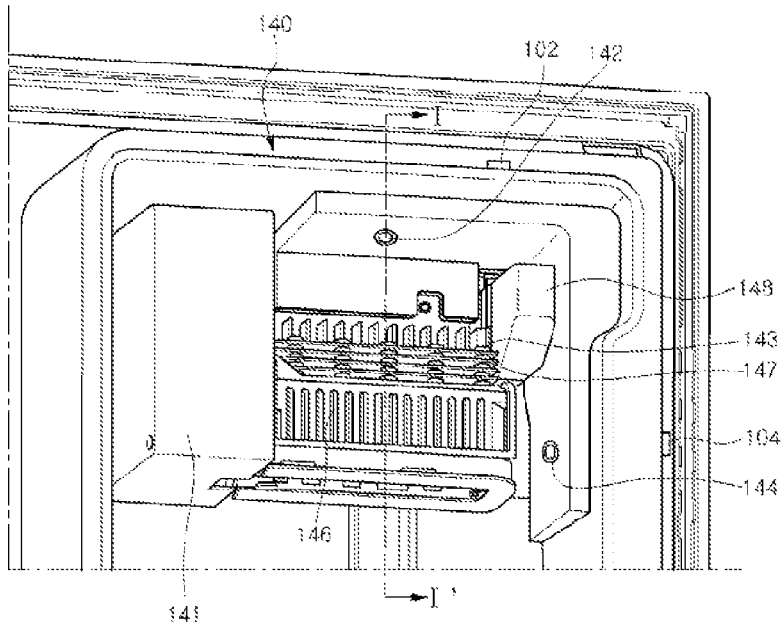
FIG. 2 is a perspective view illustrating the configuration of an ice-making unit according to the embodiment of FIG. 1.
Figure 3:
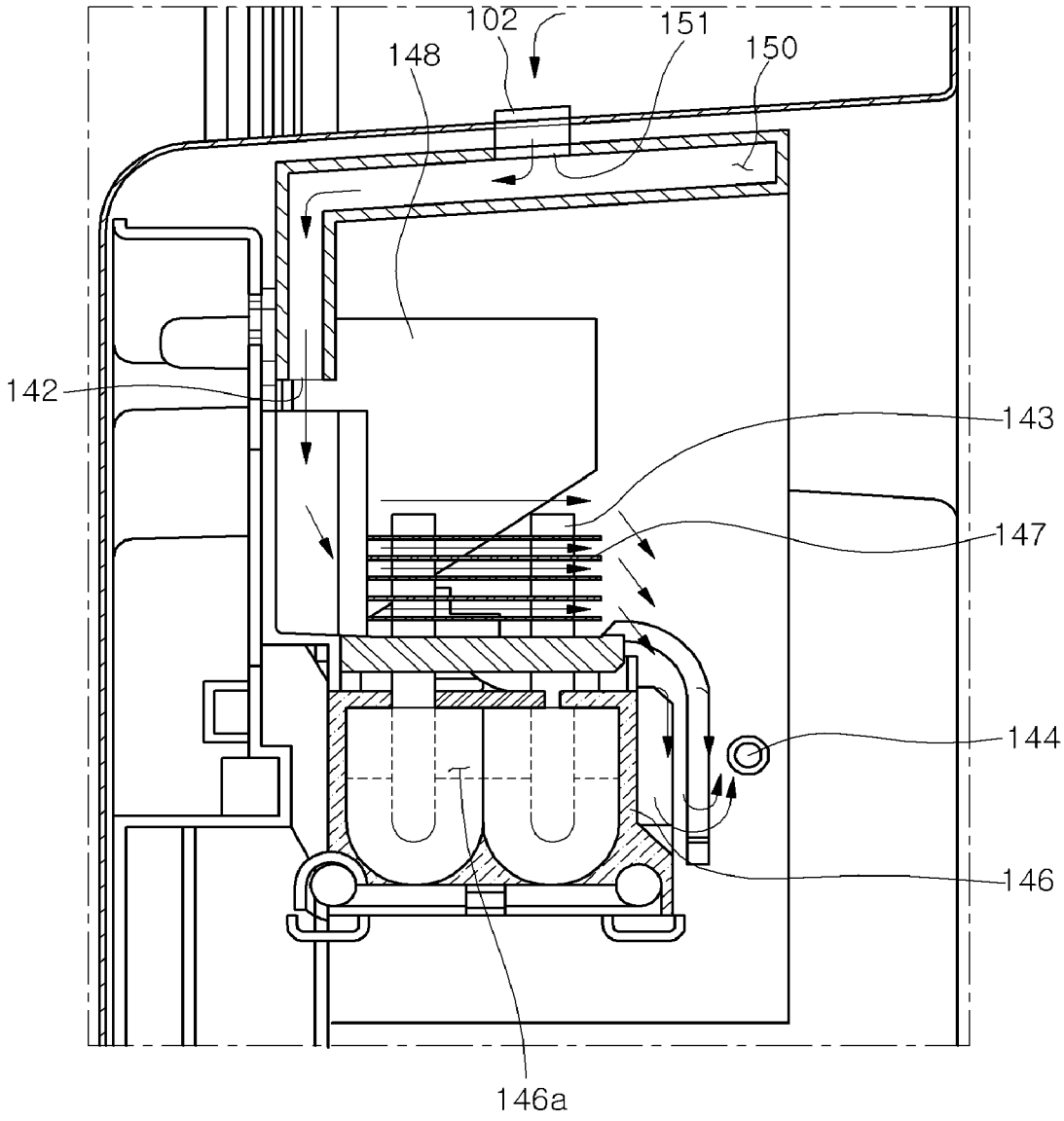
FIG. 3 is a cross-sectional view taken along line I-I' of FIG. 2.

FIG. 2 is a perspective view illustrating the configuration of the ice-making unit 140 according to the embodiment of FIG. 1. FIG. 3 is a cross-sectional view taken along line I-I' of FIG. 2.

Referring to FIGS. 2 and 3, the ice-making device 100, which is designed to make ice and for a user to access the ice, is provided at the inner surface of the chilling chamber door 13.

In detail, the ice-making device 100 includes the ice-making unit 140 for making the ice using water supplied, an ice bank (not shown) that is disposed under the ice-making unit 140 to store the ice made by the ice-making unit 140, a dispenser (not shown) for dispensing the ice stored in the ice bank.

The following will describe the structure of the ice-making unit 140 in more detail.

The ice-making unit 140 includes the water supply unit 148 for supplying water from an external side, the ice tray 146 in which the water supplied from the water supply unit 148 is frozen into ice, one or more freezing cores 143 for freezing the water supplied into the ice tray 146, and one or more heat transferring fins 147 for effectively transferring heat from the freezing cores 143.

In detail, the freezing cores 143 are provided above the ice tray 146. In order to effectively utilize a space, the freezing cores 143 may be arranged in two lines, but are not limited thereto. For example, the freezing cores 143 may be arranged in two or more lines.

The freezing cores 143 may be formed in a bar shape extending in a vertical direction. At least one portion of the freezing cores 143 is stored in an ice-making spaces 146*a*.

Further, the heat-transferring fins 147 are formed in a plate shape and provided on an outside of the freezing cores 143. Each of the heat transferring fins 147 is provided with a plurality of holes corresponding to diameters of the freezing cores 143. That is, the freezing cores 143 are allowed to be inserted in the holes of the heat transferring fins 147. The heat transferring fins 147 may be spaced apart from each other in a length direction of the freezing cores 143.

As described above, as the heat transferring fins 147 having the layers are disposed to contact the out side of each of the freezing cores 143, the heat transfer by the cool air can be more effectively realized.

Further, the freezing cores 143 and the heat transferring fins 147 are provided above the ice tray 146 to be capable of moving upward. The freezing cores 143 and the heat transferring fins 147 are provided to be capable of rotating in a state where they are moved upward.

The ice-making unit 140 further includes a control box 141 that enables the freezing cores 143 and the heat transferring fins 147 to move and rotate. The control box 141 may include a motor (not shown) for providing driving force to the freezing cores 143 and the heat transferring fins 147 and a cam unit (not shown) for transferring the driving force of the motor.

The ice tray 146, as well as the freezing cores 143 and the heat transferring fins 147, may be rotatably connected to the control box 141.

The ice-making spaces 146*a* correspond to the size of ice formed in the ice tray 146. Since the freezing cores 143 are disposed on an upper side of the ice-making spaces 146*a*, the number of the ice-making spaces 146*a* may correspond to the number of the freezing cores 143. Water supplied to the ice-making spaces 146*a* contacts the freezing cores 143 so as to be frozen.

Lower portions of the ice-making spaces 146*a* are rounded, and thus, a lower portion of ice is also rounded.

The ice-making device 100 includes the cool air supply part 102 in an upper portion thereof. The cool air supply part 102 is configured to supply cool air, introduced from the freezing chamber 12, to the ice-making device 100, when the chilling chamber door 13 is closed. As described above, the cool air supply part 102 may communicate with the duct supply hole 22*a*.

In addition, a cool air passage 150 along, which the cool air introduced through the cool air supply part 102 flows, is provided on a lower side of the cool air supply part 102. A cool air introduction part 142, through which the cool air is introduced into the ice-making unit 140, is formed at a first end of the cool air passage 150.

That is, cool air, delivered from the freezing chamber 12, flows into the cool air passage 150 through the cool air supply part 102, and is introduced into the ice-making unit 140 through the cool air introduction part 142. The cool air introduced into the ice-making unit 140 flows toward the upper side of the freezing cores 143.

Here, to uniformly deliver the cool air to the freezing cores 143, the cool air introduction part 142 may be disposed at a position having approximately similar distances from the respective freezing cores 143, i.e., in a vertical line to the freezing core 143 at a center of the freezing cores 143. Thus, the cool air introduction part 142 is closest to the freezing core 143 disposed at the center of the arranged freezing cores 143.

As described above, the cool air supply part 102 is provided on an upper side of the ice-making unit 140, and cool air is supplied from an upper portion of the ice-making unit 140 toward a lower portion of the ice-making unit 140, i.e., from an upper portion of the freezing cores 143 toward the ice tray 146.

Thus, since the freezing cores 143 are uniformly cooled by cool air and maintained at a low temperature adapted to make ice, ice-making performance is improved to increase the amount of ice made. Also, the performance of making clear ice is improved.

One side surface (left surface or right surface) of the ice-making unit 140 is provided with a cool air outlet 144 to discharge cool air passing through the freezing cores 143 and the ice tray 146 out of the ice-making unit 140. The cool air outlet 144 communicates with the cool air discharge part 104 provided to the side surface of the ice-making device 100.

Accordingly, the cool air discharged through the cool air outlet 144 is directed to the freezing chamber 12 through the discharge duct 24 via the cool air discharge part 104.

Therefore, the cool air is supplied from the upper portion of the ice-making unit 140 to the lower portion of the ice-making unit 140 and discharged toward one side of the ice-making unit 140. Therefore, the cool air is uniformly supplied to the freezing cores 143 and thus the freezing of the water can be uniformly realized.

The operation of an ice-making unit 140 will now be described.

Water supplied from the water supply unit 148 to the ice-making spaces 146*a* of the ice tray 146, contacts the freezing cores 143. That is, the freezing cores 143 may be partially immersed in water.

Then, when cool air is supplied through the cool air supply part 102 into the ice-making unit 140, the freezing cores 143 are cooled, and in this process, the water contacting the freezing cores 143 is cooled and converted into ice.

Here, the cool air flows from an upper side of the freezing cores 143 to a lower side of the freezing cores 143, and the cool air passing through the freezing cores 143 moves through the cool air discharge part 104 to the main body 10.

Hereinafter, an ice-making device 100 is described according to another embodiment. This embodiment is the same as the previous embodiment except for configuration of the ice-making device 100. Thus, the difference will be mainly described, and the same parts will be described using the reference numerals and the description of the previous embodiment.

Figure 4:
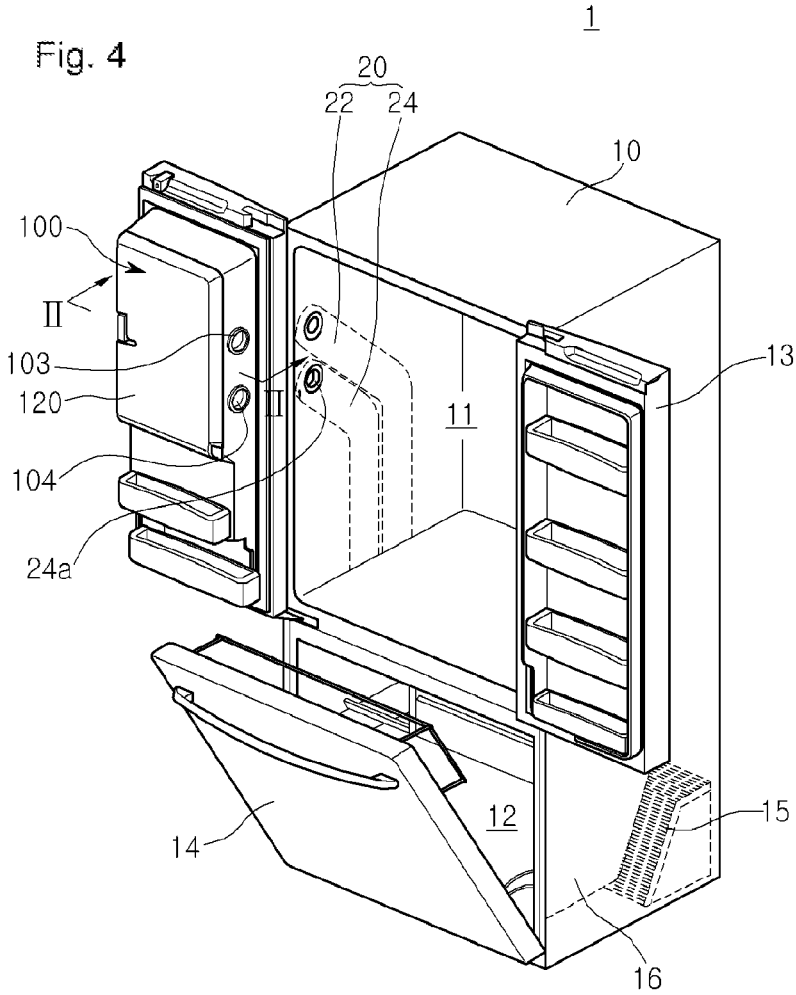
FIG. 4 is a perspective view illustrating the configuration of a refrigerator door according to an another embodiment.
Figure 5:
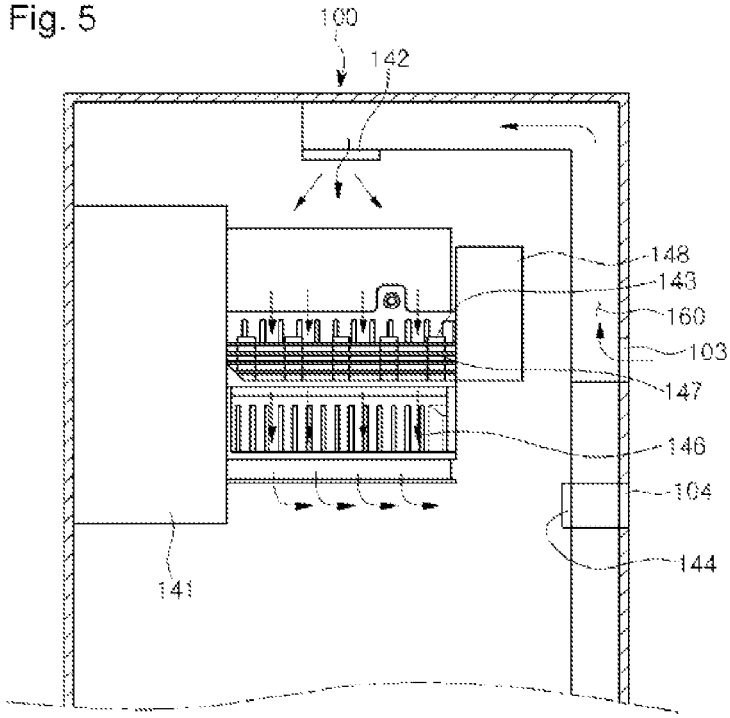
FIG. 5 is a cross-sectional view taken along line II-II' of FIG. 4.

FIG. 4 is a perspective view illustrating the configuration of a refrigerator door according to this embodiment. FIG. 5 is a cross-sectional view taken along line II-II' of FIG. 4.

Referring to FIGS. 4 and 5, a lateral surface of the ice-making device 100 according to this embodiment is provided with a cool air supply part 103 to which cool air delivered from a freezing chamber 12 is introduced. A lower side of the cool air supply part 103 is provided with a cool air discharge part 104 where cool air circulating in the ice-making device 100 is discharged.

Since the cool air supply part 103 is provided to the lateral surface of the ice-making device 100, the cool air supply part 103 easily communicates with the supply duct 22.

A cool air passage 160, where cool air introduced through the cool air supply part 103 flows, is provided in the ice-making unit 140. The cool air passage 160 extends toward an upper portion of the ice-making unit 140, and one side end of the cool air passage 160 is provided with a cool air introduction part 142 configured to introduce cool air into the ice-making unit 140.

That is, the cool air introduction part 142 is provided to the upper portion of the ice-making unit 140, and cool air introduced through the cool air introduction part 142 flows from the upper portion of the ice-making unit 140 toward a lower portion of the ice-making unit 140.

The introduced cool air flows to a lower portion of the ice tray 146 through the freezing cores 143 to cool the freezing cores 143. It will be appreciated that the freezing cores 143 effectively transfer heat through the heat transferring fins 147.

One side of the ice-making device 100 is provided with the cool air discharge part 104 configured to discharge cool air circulating in the ice-making unit 140. The cool air discharge part 104 and the cool air supply part 103 may be disposed on the same side surface. As described above, the cool air supply part 103 and the cool air discharge part 104 are allowed to respectively communicate with the supply duct 22 and the discharge duct 24 when the chilling chamber door 13 is closed.

According to the above configuration, cool air introduced into the ice-making unit 140 is supplied from the upper side of the ice-making unit 140 to the lower side of the ice-making unit 140 so as to directly contact the freezing cores 143. The supplied cool air uniformly acts on the respective freezing cores 143, so that the temperatures of the respective freezing cores 143 are uniformly formed.

Therefore, ice-making performance of the ice-making unit 140 is improved, and ices having uniform sizes are formed, and the performance of making clear ice is improved.

Figure 6:
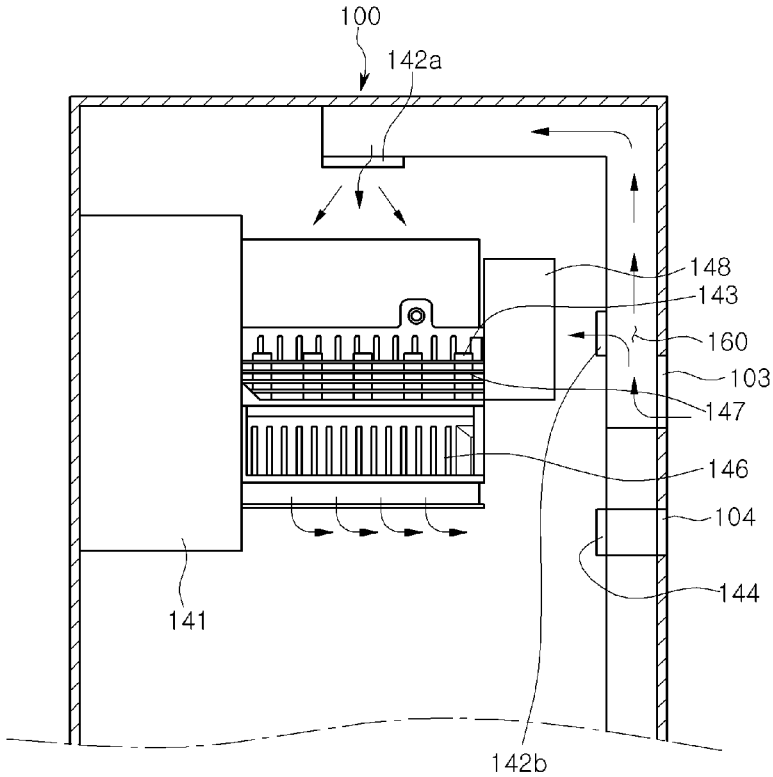
FIG. 6 is a cross-sectional view illustrating the configuration of a refrigerator door according to an another embodiment.

FIG. 6 is a cross-sectional view illustrating the configuration of a refrigerator door according to an embodiment.

Referring to FIG. 6, the cool air passage 160 may be provided with a first cool air introduction part 142*a* and a second cool air introduction part 142*b* to which cool air is introduced.

The first cool air introduction part 142*a* may be disposed in the upper portion of the ice-making unit 140, and the second cool air introduction part 142*b* may be disposed on the left surface or the right surface of the ice-making unit 140.

The second cool air introduction part 142*b* may be disposed on an upper side of the cool air outlet 144.

That is, the cool air passage 160 may be provided with a plurality of cool air introduction parts configured to introduce cool air.

Cool air introduced at the first cool air introduction part 142*a* may flow from an upper side of the ice tray 146 toward a lower side of the ice tray 146. Cool air introduced at the second cool air introduction part 142*b* may move toward a left surface or a right surface of the ice tray 146.

Therefore, cool air supplied through the cool air supply part 103 flows through the cool air passage 160 and branches into the first cool air introduction part 142*a* and the second cool air introduction part 142*b*.

That is, at least one portion of the cool air is introduced through the cool air introduction part 142, and the rest of the cool air may be introduced into the ice-making unit 140 through the second cool air introduction part 142*b*.

According to the above configuration, cool air is introduced into the cool air introduction parts. Thus, the freezing cores are appropriately cooled, and the left surface and the right surface of the ice tray are cooled by cool air introduced through the second cool air introduction part.

INDUSTRIAL APPLICABILITY

The embodiments relate to a refrigerator configured to improve the structure of an ice-making chamber provided to a refrigerator door, thereby efficiently supplying cool air into the ice-making chamber.

In the refrigerator having the above configuration, cool air is supplied from an upper side of the ice-making chamber provided to the refrigerator door, so that the cool air is directly supplied to a plurality of freezing cores.

The invention claimed is:

1. A refrigerator comprising: a main body comprising a chilling chamber and a freezing chamber; a refrigerator door coupled to the main body to open or close the chilling chamber; an ice-making device positioned at the refrigerator door and configured to make ice, the ice-making device comprising a case; a cool air supply part positioned on the case and configured to supply cool air generated from the freezing chamber to inside of the case; a freezing core vertically arranged in the ice making unit and cooled by cool air case, the freezing core comprising an upper portion and a lower portion; an ice tray disposed below the freezing core, the ice tray having a space to receive at least one the lower portion of the freezing core therein; at least one heat-transferring fin coupled to the freezing core, the at least one heat-transferring fin comprising a hole into which the upper portion of the freezing core is inserted; a cool air introduction part coupled to the cool air supply part to extend to an upper side of the freezing core such that cool air discharged from the cool air introduction part flows to the upper portion of the freezing core; and a cool air outlet positioned at a side of the ice tray to discharge the cool air to outside of the case, wherein the at least one heat-transferring fin is arranged horizontally to guide the cool air to the cool air outlet.

2. The refrigerator according to claim 1, wherein the freezing core comprises a plurality of freezing cores, and the freezing cores are spaced apart from each other.

3. The refrigerator according to claim 2, wherein the cool air introduction part is closest to the freezing core disposed at a center of the freezing cores.

4. The refrigerator according to claim 1, where in the at least one heat transferring find comprises a plurality of heat transferring find and the at least one heat transferring fins are spaces apart from each other in a longitudinal direction of the freezing core.

5. The refrigerator according to claim 1, wherein the ice tray is provided with water, and at least one portion of the freezing core is immersed in the water.

6. The refrigerator according to claim 1, wherein the cool air discharged from the cool air introduction part flows in a longitudinal direction of the freezing core.

7. The refrigerator according to claim 1, wherein the case comprises a top, a bottom, a front wall, and a pair of side walls, and the cool air supply part is positioned at the top of the case.

8. The refrigerator according to claim 1, wherein the case comprises a top, a bottom, a front wall and a pair of side walls, and the cool air supply part is positioned at one of the side walls of the case.

9. The refrigerator according to claim 1, wherein the cool air introduction part is a first cool air introduction part, further comprising a second cool air introduction part positioned at a side wall of the case.

10. The refrigerator according to claim 9, wherein the cool air supplied through the cool air supply part branches into the first and second cool air introduction parts.

11. The refrigerator according to claim 7, further comprising an air discharge part positioned at one of the side walls of the case to discharge air to outside of the case.

12. The refrigerator according to claim 8, further comprising an air discharge part positioned at one of the side walls of the case to discharge air to outside of the case.

13. The refrigerator according to claim 12, wherein the cool air supply part is provided at an upper side of the air discharge part.

14. The refrigerator according to claim 12, wherein the cool air supply part is provided at a lower side of the air discharge part.

* * * * *